United States Patent [19]

Kraushaar

[11] 4,428,210

[45] Jan. 31, 1984

[54] FLESHING MACHINE

[75] Inventor: Stephen N. Kraushaar, Litchfield, Minn.

[73] Assignee: Mills Fur Farm Supply, Inc., Litchfield, Minn.

[21] Appl. No.: 384,788

[22] Filed: Jun. 4, 1982

[51] Int. Cl.[3] ..... C14B 1/02

[52] U.S. Cl. ..... 69/46

[58] Field of Search ..... 69/1, 37, 46

[56] References Cited

U.S. PATENT DOCUMENTS 3,081,615 3/1963 Thelen ..... 60/46

*Primary Examiner*—Patrick D. Lawson

*Attorney, Agent, or Firm*—James R. Haller

[57] ABSTRACT

The invention provides an improvement in a fleshing machine comprising dual linking means mechanically and hydraulically linking the handle to the tissue-removing head for hydraulically moving the head longitudinally of the mandrel in response to longitudinal components of movement of the handle with respect to the mandrel and for mechanically moving the head generally transversely of the mandrel in response to components of handle movement generally transverse of the longitudinal direction of the mandrel.

5 Claims, 6 Drawing Figures

10
12.2
28
28.2
13
12.5
12.6
12.1
12.9
12.1
12.3
28.1
28.3
22
24.1
24
24.5
28.4
26.7
26
26.3
16.4
20.4
26.1
26.2
18.2
20.3
20.1
28.4
26.4
18
16.1
20
14
12.1
16
12.4
12.7
18.3
13
12.8
12.1

FLESHING MACHINE

TECHNICAL FIELD

The invention relates to the field of skin or fur processing, and particularly to machines used to remove tissue from the inner surfaces of animal pelts.

BACKGROUND ART

In the fur industry, various machines are employed for processing animal pelts. In one process, an animal pelt is turned inside out and scraps of fat and other tissue are removed. This process, called "fleshing" must be carefully performed to avoid damaging the skin portion of the pelt. Yet, economics dictate that the operations be performed with some speed. It is often necessary to process many hundreds of pelts in a single day.

One device, shown in U.S. Pat. No. 3,049,906, includes a horizontal, rotatable mandrel over which a pelt, turned inside out, may be placed. A roller-mounted carriage travels transversely of the mandrel and carries a powered fleshing knife unit to remove fat and other tissue from the pelt supported on the mandrel. The motor for driving the fleshing knife tips toward and away from the mandrel about a horizontal axis generally parallel to the length of the mandrel, and is positioned by means of a horizontal handle held by one hand of the operator. Other devices are shown in U.S. Pat. Nos. 2,896,438, 3,048,995 and 3,911,703, and in Canadian Pat. No. 665,398.

A single operator may be called upon to process a great many pelts each hour. When using the machine of the above-described U.S. Pat. No. 3,049,906, the movement of the carriage bearing the motor and fleshing knife back and forth along the length of the mandrel becomes very tiring. Expert workmen in this area develop a "feel" for the operation of the machine. The fleshing knife or other flesh-removing device is to be pressed and moved against the pelt with a carefully applied force sufficient to remove fat and other tissue and not cut into or damage the skin of the pelt. When one tires from moving the carriage back and forth along the length of the mandrel as successive pelts are processed, the "feel" of the operator tends to diminish, which can lead to spoiled pelts and diminished production.

DISCLOSURE OF INVENTION

The present invention provides an improvement in a fleshing machine of the type shown in U.S. Pat. No. 3,049,906.

The fleshing machine includes an elongated mandrel for holding a pelt, and fleshing means moveable longitudinally and also generally transversely (e.g., radially) with respect to the mandrel for removing fat and other tissue from the inner surface of the pelt, such that movement of the fleshing means obliquely of the mandrel will include generally transverse and generally longitudinal components of movement with respect to the mandrel. The fleshing means includes a tissue-removing head such as that shown in U.S. Pat. No. 3,049,906, and an operating handle. The improvement comprises dual linking means mechanically and hydraulically linking the handle to the tissue-removing head for hydraulically moving the head in response to longitudinal components of movement of the handle with respect to the mandrel and for mechanically moving the head transversely toward and away from the mandrel in response to components of handle movement generally transversely of the mandrel. The mechanical responsiveness of the tissue-removing head preserves to the operator a "feel" of pressure of the head against the pelt, whereas the hydraulic responsiveness of the head provides a hydraulic power assist to greatly reduce the fatigue of the operator as the fleshing means is moved back and forth longitudinally of the mandrel during a fleshing operation. This is particularly important in view of the fact that, during a fleshing operation, the fleshing means may be caused to travel the length of the mandrel and back again as many as 45 times or more per minute. The dual mechanical-hydraulic linking means hence preserves the "feel" of the fleshing operation but yet reduces fatigue resulting from movement of the fleshing head longitudinally of the mandrel. Further, but a single operating handle is employed to control both the mechanical and hydraulic linkage elements of the linking means between the handle and the tissue-removing head.

In operation, after a pelt has been mounted to the mandrel in a known manner, the operator begins at one end of the mandrel and moves the tissue-removing head against the pelt and also longitudinally of the mandrel so that an elongated strip of the pelt is freed from flesh. The mandrel is then rotated slightly to bring a new portion of the pelt into line with the tissue-removing head, and the head, with controlled pressure against the pelt, is again moved longitudinally of the mandrel to remove another strip of flesh from the pelt. This process is continued until the fleshing operation is completed. Since the pelt is not of uniform thickness, and since some portions of the pelt have more flesh to be removed than other portions, it will be understood that the head must move in an uneven path across the pelt surface, such movement having both longitudinal and generally radial components as described above.

In a preferred embodiment, the invention relates to an improvement in a fleshing machine having a frame, a longitudinal mandrel carried by the frame, rail means carried by the frame substantially parallel to the mandrel, a carriage carried by the rail and moveable longitudinally of the mandrel, and fleshing means including a fleshing head carried by the carriage and moveable with respect to the mandrel. The improvement comprises an operating handle, means pivotally attaching the handle to the carriage to permit limited pivotal movement of the handle obliquely of the longitudinal direction of the mandrel, such movement thus having both parallel and transverse components with respect to the longitudinal direction of the mandrel. Mechanical linking means are provided to link the handle to the fleshing head for mechanically moving the head toward and away from the mandrel in response to transverse components of handle movement. Hydraulic linking means hydraulically link the handle to the carriage to hydraulically move the carriage longitudinally of the mandrel in response to components of handle movement longitudinally of the mandrel.

The hydraulic linking means preferably comprises hydraulic cylinder means for moving the carriage longitudinally of the mandrel, a source of pressurized hydraulic fluid, and hydraulic valve means responsive to components of handle movement longitudinal of the mandrel for communicating the source of pressurized hydraulic fluid with the hydraulic cylinder to affect movement of the carriage.

The handle itself preferably is provided with a manual grip adjacent the mandrel, and the hydraulic and mechanical linking means are so constructed and arranged as to cause the tissue-removing head to move in a manner substantially following and mimicking movement of the handle grip.

DETAILED DESCRIPTION OF THE EMBODIMENT

Figure 1:
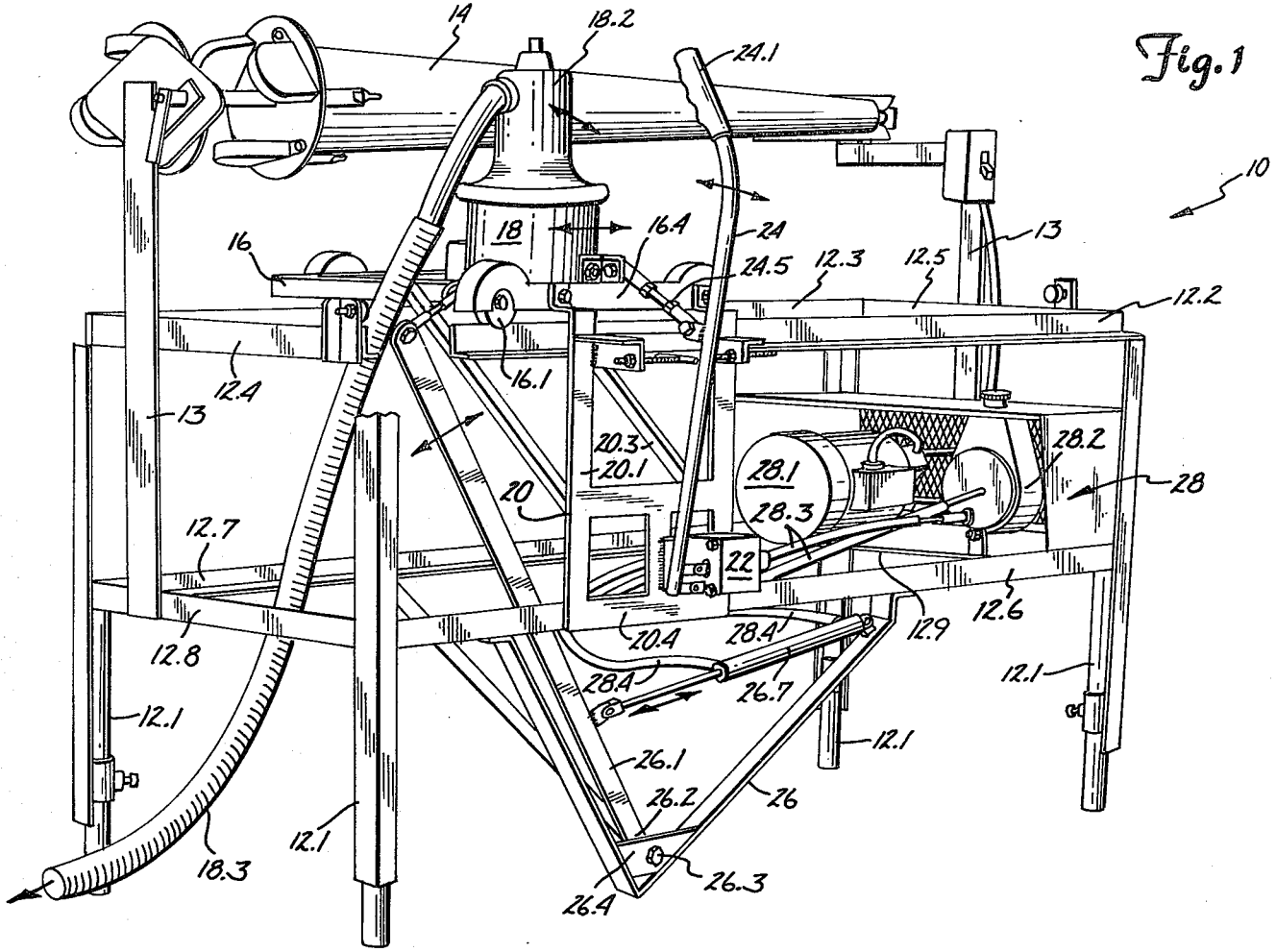
FIG. 1 is a perspective view of the fleshing machine of the invention.

Referring first to FIG. 1, an apparatus of the invention is designated generally as (10), and includes a rigid frame (12) having adjustable-height legs (12.1) at its corners. The frame includes upper parallel frame members (12.2, 12.3) joined at their ends by transverse frame members (12.4, 12.5) to form an elongated, generally rectangular open upper frame assembly. A similar frame assembly, spaced below the upper frame assembly, is provided by parallel frame members (12.6, 12.7) joined at their ends by transverse frame members (12.8, 12.9). Extending upwardly from the end frame members (12.4, 12.8) at one end and (12.5, 12:9) at the other end of the device are vertical supports (13) between which are supported elongated, tapered pelt-receiving mandrels (14) of the type shown in U.S. Pat. No. 3,049,906, the disclosure of which is incorporated herein by reference. The mandrels, of which there are preferably two so that they can be used alternately, are adapted to receive an inside-out pelt.

Figure 2:
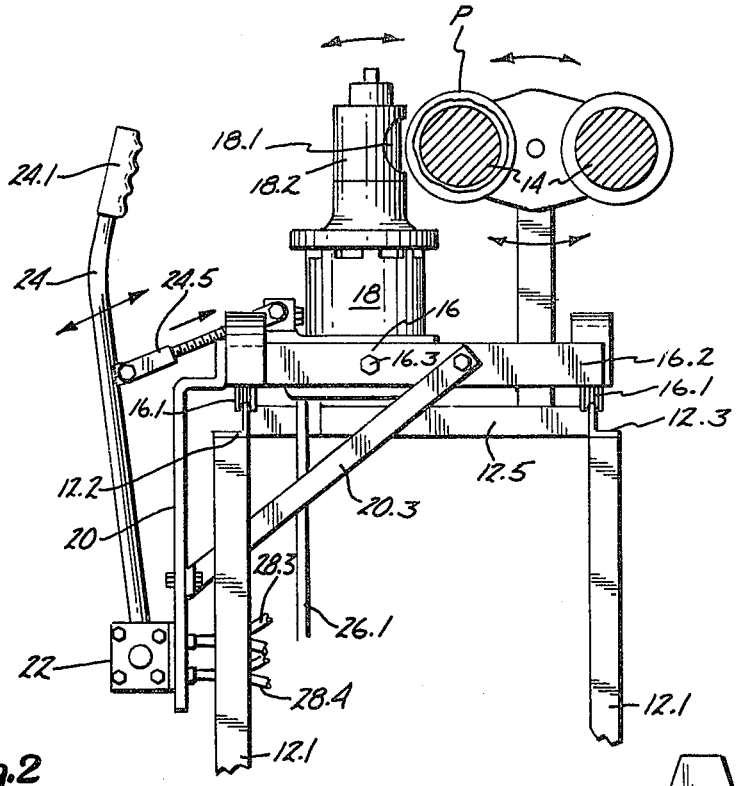
FIG. 2 is a partially broken-away end view of the machine shown in FIG. 1.

The elongated top frame members (12.3, 12.2) define parallel rails upon which is mounted a carriage, designated generally as (16), the carriage being generally rectangular and having wheels (16.1) riding on the frame rails (12.2, 12.3) so that the carriage may be rolled from one end of the frame to the other. The carriage (16) has end portions, of which one is shown at (16.2) in FIG. 2, and an electric motor (18) is pivotally mounted by means of axle members (16.3) within the carriage (16) to the carriage end portions (16.2). To the generally vertical shaft of the motor (18) is mounted a fleshing head (18.1) which may take the form of a cylinder having generally radially extending rubber paddles, which, when urged against the surface of a pelt (designated "P" in FIG. 2), strips away fat and other unwanted tissue from the pelt. The fleshing head (18.1) may be largely enclosed within a housing (18.2) to which in turn may be connected a vacuum line (18.3) for the purpose of drawing away fat and other unwanted tissue from the vicinity of the fleshing head. The axle members (16.3), the mutual axis of which is horizontal and parallel to the frames (12.2, 12.3), pivotally mount the motor to the carriage (16) at a point slightly above the center of gravity of the combined motor (18), fleshing head (18.1) and housing (18.2) so that the motor normally assumes the upright position shown in FIG. 2. It will now be understood that the motor may pivot toward the mandrel (14) to thus bring the fleshing head into contact with the pelt "P."

A bracket designated generally as (20) is mounted rigidly to the carriage (16), the bracket having a pair of upright frame members (20.1) that may be bolted at their upper ends (20.2) to a side member (16.4) of the carriage. Struts (20.3) extend from the upright frames (20.1) for attachment to the ends (16.2) of the carriage, thereby rigidifying the bracket with respect to the carriage. A lower cross frame member (20.4) joins the bottom ends of the upright frame members (20.1), and a second cross member (20.5) may be placed above the member (20.4) between the upright frames (20.1) to add stiffness to the bracket.

To the bottom of the bracket (20) is mounted a hydraulic valve, typically a commercially available spool valve (22), the valve including a horizontally extending plunger or spool axle member (22.2). An elongated, generally upright handle (24) having an upper handgrip (24.1) is pivotally mounted at its lower end (24.2) to the bracket (20), as by the fastener shown at (24.3). The lower end (24.2) of the handle, slightly above its pivotal connection to the bracket, is pivotally mounted as well to the plunger (22.1) of the spool valve (22); the plunger (22.1) may have a bifurcated end (22.2) passing on either side of a fastener plate (24.4) carried by the lower end of the handle (24), the bifurcated end (22.2) being pivotally pinned, as by a bolt (22.3) to the plate (24.4). The thus-described pivotal connection of handle (24) to the bracket (20) and valve (22) permits the handle to be pivoted lengthwise of the machine, i.e., generally parallel to the mandrels, and also normal to the length of the machine, i.e., at right angles to the mandrels. The thus-described pivotal connections are sufficiently loose as to permit some play in the handle when the latter is pivoted transversely of the mandrels, but even slight pivotal movement of the handle longitudinally of the mandrels causes the plunger (22.1) of the valve (22) to shift within the valve.

A short, adjustable-length strut (24.5), typifying mechanical linkage means, is pivotally attached at one end to the handle (24) approximately mid-way along its length, and is pivotally attached at its other end to the motor (18), whereby pivotal movement of the handle transversely of the length of the machine causes the motor to pivot or tilt about its axle members (16.3) to bring the fleshing head (18.1) toward and away from the mandrel (14).

Figure 4:
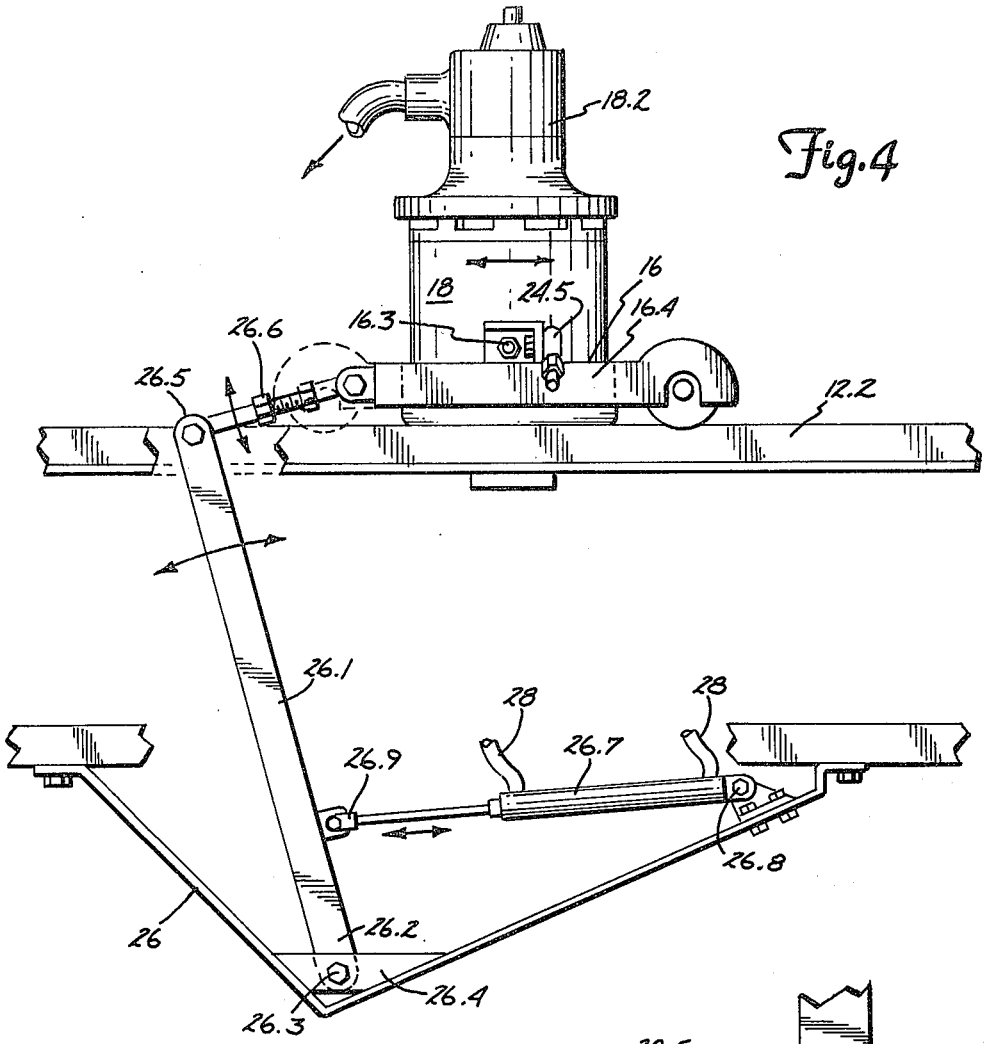
FIG. 4 is a broken-away view showing a portion of the device of FIG. 1.
Figure 5:
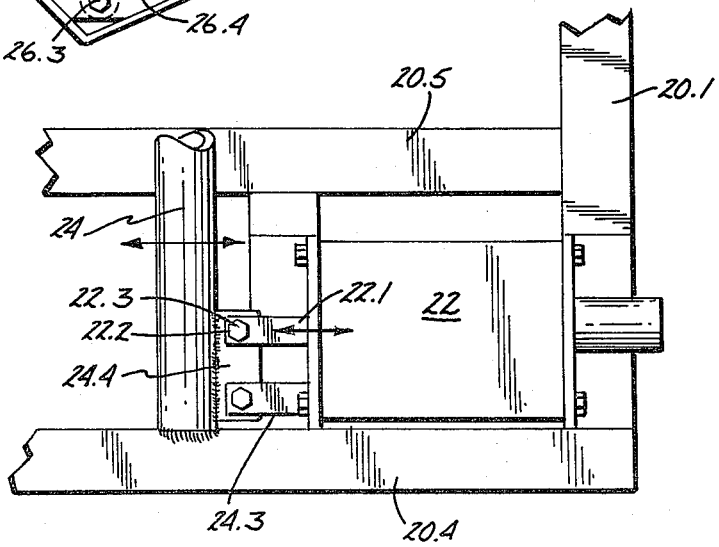
FIG. 5 is a broken-away view showing a portion of the device of FIG. 1.
Figure 6:
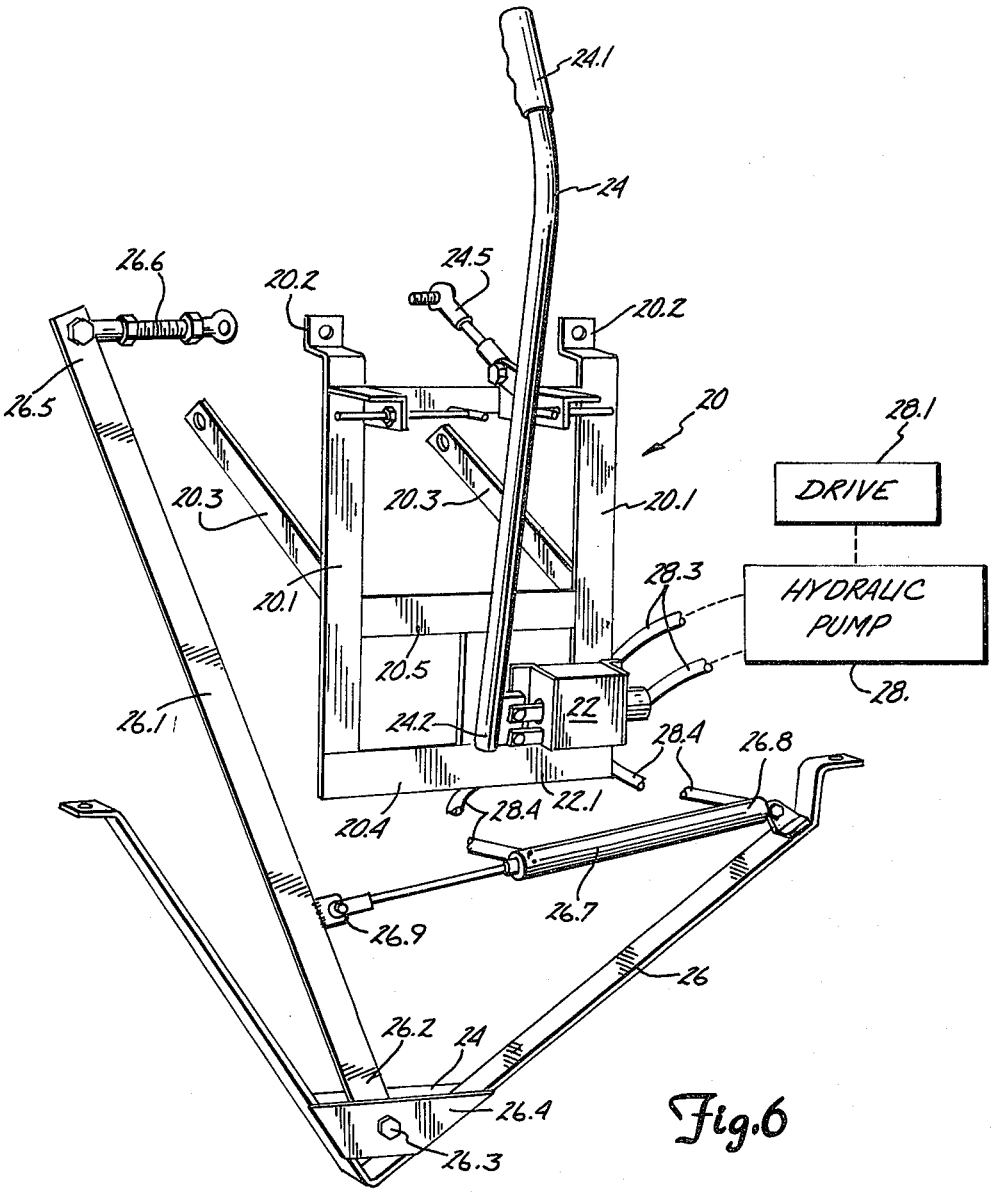
FIG. 6 is a perspective view of a kit employed for modifying existing fleshing machines in accordance with the instant invention.

A generally V-shaped, elongated bracket (26) is mounted at its ends to the elongated frame (12.6), as shown best in FIGS. 1 and 4. A level (26.1) is pivotally mounted at its lower end (26.2) to the V-shaped bracket adjacent its vertex by a pin (26.3) which passes through parallel, spaced side plates (26.4) mounted to the V-shaped bracket (26). At its upper end (26.5), the lever is pivotally attached to one end of an adjustable length strut (26.6) similar to the above-described strut (24.5). At its other end, the strut (26.6) is pivotally attached to the carriage (16) such that pivotal movement of the lever (26.1) in a generally vertical plane parallel to the length of the machine (i.e., parallel to the length of the mandrels (14)) causes the carriage (16) to roll along the length of the machine. A hydraulic cylinder (26.7) is pivotally attached at one end (26.8) to the V-shaped bracket (26) adjacent and end of the latter, and the cylinder piston is attached pivotally at its other end (26.9) to the lever (26.1) at a point spaced above the lower end (26.2) of the lever.

Figure 3:
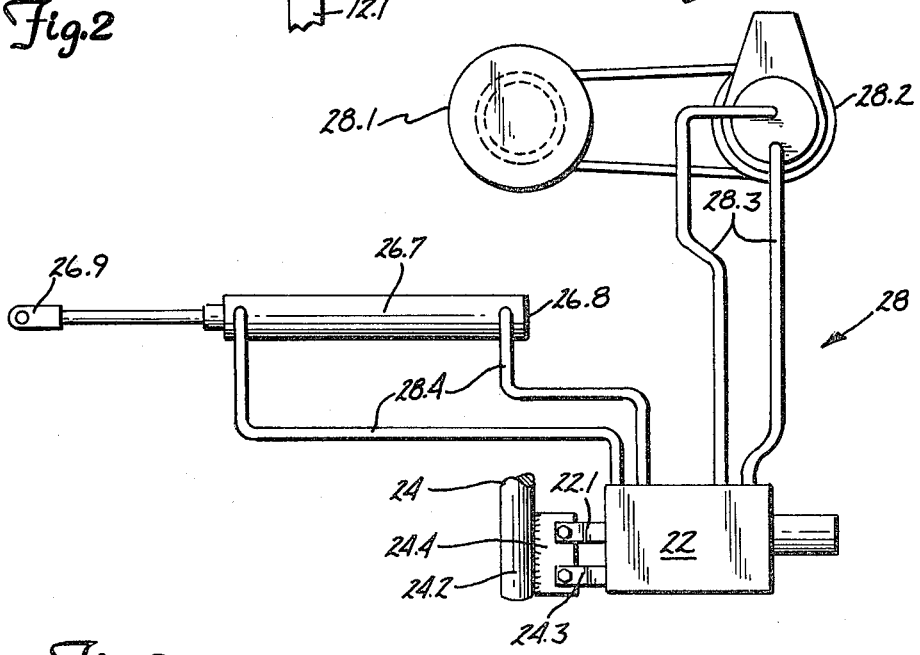
FIG. 3 is a schematic view of the hydraulic system employed in the apparatus of FIG. 1.

A hydraulic system designated (28) is shown in FIG. 1 and is depicted schematically in FIG. 3. The system (28) includes an electric drive motor (28.1) powering an hydraulic pump (28.2) which in turn communicates through hydraulic lines (28.3) with the valve (22), the motor and pump being commercially available units. Hydraulic lines (28.4), in turn, extend between ends of the hydraulic cylinder (26.7) and the hydraulic valve (22). The position of the plunger (22.1) within the valve (22), responsive to the position of the handle (24), controls the direction and amount of hydraulic fluid flow between the hydraulic pump (28.2) and the cylinder (26.7) in the usual manner, and operation of the hydraulic cylinder, in turn, causes the lever (26.1) to pivot in one direction or the other longitudinally of the mandrels and results in movement of the carriage lengthwise of the mandrels.

In operation, as will now be understood, the handle (24) and the fleshing head are connected solely by mechanical linking means, typified by the strut (24.5), with respect to components of movement of the fleshing head toward and away from the mandrel thereby preserving to an operator a sense of pressure or "feel" of the fleshing head against the pelt. The handle and fleshing head are connected only hydraulically with respect to movement of the fleshing head longitudinally of the mandrels. Preferably, the grip (24.1) of the handle (24) is carried adjacent the fleshing head (18.1), movement of the handle by the operator in a direction parallel to, transverse to or obliquely to the mandrel thus resulting in a mimicking, following movement of the fleshing head.

While a preferred embodiment of the present invention has been described, it should be understood that various changes, adaptations, and modifications may be made therein without departing from the spirit of the invention and the scope of the appended claims.

What is claimed is:

1. In a fleshing machine for removing unwanted tissue from an animal pelt and having a longitudinal mandrel for holding a pelt and fleshing means including a tissue-removing head moveable longitudinally and transversely with respect to the mandrel to remove tissue from the pelt, and a handle for moving the head with respect to the mandrel:

the improvement comprising dual linking means mechanically and hydraulically linking the handle to the tissue-removing head for hydraulically moving the head longitudinally of the mandrel in response to longitudinal components of movement of the handle with respect to the mandrel and for mechanically moving the head generally transversely of the mandrel in response to components of handle movement generally transverse of the longitudinal direction of the mandrel.

2. The improvement of claim 1 wherein the handle includes a manual grip adjacent the mandrel and wherein said dual linking means is so constructed and arranged as to cause said head to move in a manner substantially mimicking movement of the handle grip.

3. The improvement of claim 1 wherein the dual linking means includes a source of pressurized hydraulic fluid, hydraulic cylinder means for moving the head longitudinally of the mandrel, and hydraulic valve means hydraulically linking the hydraulic fluid source with the cylinder and responsive to components of movement of the handle longitudinally of the mandrel for selectively providing pressurized hydraulic fluid from said source to the hydraulic cylinder means to move the tissue-removing head longitudinally of the mandrel.

4. In a fleshing machine for removing unwanted tissue from an animal pelt and having a frame, a longitudinal mandrel carried by the frame, rail means carried by the frame substantially parallel to the longitudinal direction of the mandrel, a carriage carried by the rail and moveable longitudinally of the mandrel, and fleshing means including a tissue-removing head carried by the carriage and moveable transversely with respect to the mandrel;

the improvement comprising an operating handle, means pivotally attaching the handle the carriage to permit limited pivotal movement of the handle obliquely of the longitudinal direction of the mandrel, said movement having components respectively generally longitudinal and transverse of the longitudinal direction of the mandrel, mechanical linking means linking the handle to the tissue-removing head for mechanically moving the head toward and away from the mandrel in response to transverse components of handle movement, and hydraulic linking means hydraulically linking the handle to the carriage for moving the carriage longitudinally of the mandrel in response to longitudinal components of handle movement.

5. The improvement of claim 4 wherein the hydraulic linking means include hydraulic cylinder means for moving the carriage longitudinally of the mandrel, a source of pressurized hydraulic fluid, and hydraulic valve means responsive to longitudinal components of handle movement and communicating the source of pressurized hydraulic fluid with the hydraulic cylinder to effect movement of said carriage longitudinally of the mandrel.

* * * * *